United States Patent [19]

Fisher

[11] Patent Number: 4,986,098

[45] Date of Patent: Jan. 22, 1991

[54] VEHICLE DOOR LATCHES AND LOCKING MECHNAISM

[75] Inventor: Sidney E. Fisher, Solihull, England

[73] Assignee: Rockwell Automotive Body Components (UK) Ltd., United Kingdom

[21] Appl. No.: 229,058

[22] Filed: Aug. 5, 1988

[30] Foreign Application Priority Data

Aug. 7, 1987 [GB] United Kingdom ..... 8718710

[51] Int. Cl.[5] ..... E05B 53/00

[52] U.S. Cl. ..... 70/262; 70/264; 70/277; 292/216

[58] Field of Search ..... 70/262–264, 70/256, 275, 277, 279, 283; 292/201, 207, 216, 199

[56] References Cited

U.S. PATENT DOCUMENTS

| | | | |
|---|---|---|---|
| 2,922,672 | 1/1960 | Van Voorhees | 70/262 X |
| 3,070,183 | 12/1962 | Horton | 70/264 X |
| 3,504,511 | 4/1970 | Allen | 292/216 X |
| 3,653,237 | 4/1972 | DuRocher | 70/264 |
| 4,093,289 | 6/1978 | Inabayashi et al. | 292/201 X |
| 4,272,112 | 6/1981 | Schlick et al. | 292/199 X |
| 4,342,209 | 8/1982 | Kleefeldt | 70/264 |
| 4,433,355 | 2/1984 | Chew et al. | 70/277 X |
| 4,492,395 | 1/1985 | Yamada | 292/216 |
| 4,601,500 | 7/1986 | Bernard | 292/210 |
| 4,624,491 | 11/1986 | Vincent | 292/216 X |
| 4,723,454 | 2/1988 | Periou et al. | 292/201 X |
| 4,735,447 | 4/1988 | Kleefeldt | 292/216 |
| 4,763,936 | 8/1988 | Rogakos et al. | 292/216 X |
| 4,766,747 | 8/1988 | Ernest | 70/264 |
| 4,802,350 | 2/1989 | Periou | 292/216 X |

FOREIGN PATENT DOCUMENTS

| | | | |
|---|---|---|---|
| 0095988 | 7/1983 | European Pat. Off. . | |
| 0102263 | 7/1983 | European Pat. Off. . | |
| 0117560 | 9/1984 | European Pat. Off. | 70/262 |
| 2034802 | 6/1980 | United Kingdom | 70/263 |
| WO87/02738 | 5/1987 | World Int. Prop. O. . | |

*Primary Examiner*—Gary L. Smith
*Assistant Examiner*—Suzanne L. Dino
*Attorney, Agent, or Firm*—Charles Berman

[57] ABSTRACT

Rotating claw or other vehicle door latch assembly has locking mechaism including a crank element (33) rotatable about a first axis (34) between angular positions at which the latch is locked or unlocked, a push-pull linkage (38), e.g. of a door sill button, being connected to a second axis (35) of said element for manual actuation thereof, deadlocking means (31,40) being selectively operable to position the crank element with said axis substantially in line with the direction of movement of the linkage so that the latter cannot be used to effect movement of said element which would unlock the latch.

12 Claims, 8 Drawing Sheets

VEHICLE DOOR LATCHES AND LOCKING MECHNAISM

Figure 1A:
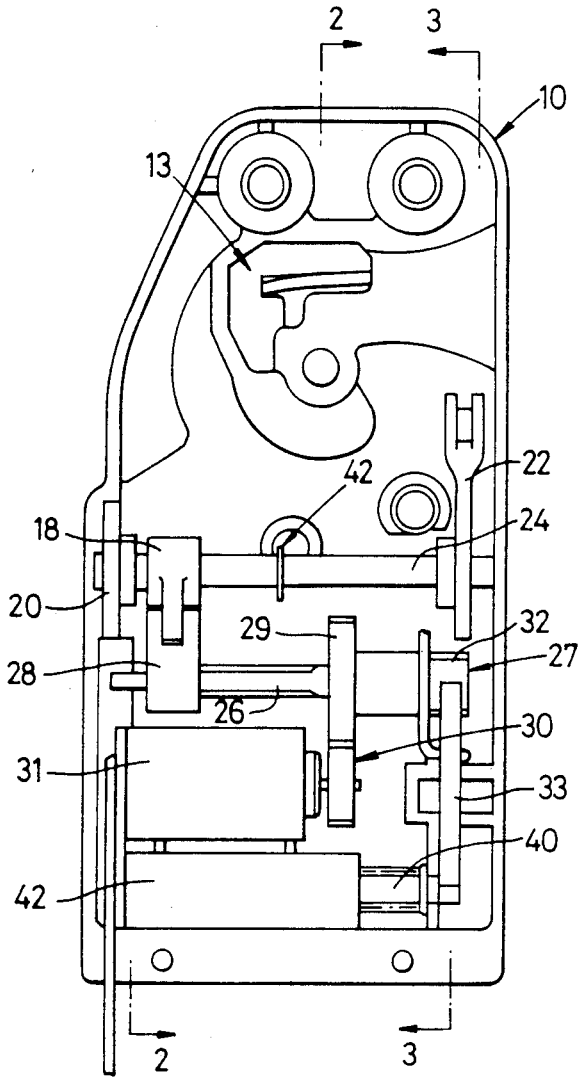

This invention relates to vehicle door latches and their associated locking mechanisms for securing the vehicle against unauthorised entry while left unattended and/or possibly for the better protection of the occupants in hazardous situations or should the vehicle be attacked while in use.

Rising vehicle-associated crime rates such as theft of or from vehicles and increasing values of vehicle and their equipment has caused increasing demand for maximum security from police and other authorities, insurers and vehicle owners with particular demand for more effective and tamper proof door locking mechanisms and the object of the present invention is the provision of economical, reliable and particulary secure locking mechanism and door latch assemblies incorporating such mechanism.

A further object is the provision of secure locking mechanism with deadlocking facility which can readily be incorporated into a vehicle locking system operating on all the vehicle doors simultaneously and/or can be actuated mechanically or electrically.

The invention may be applied to various forms of vehicle door latch of the kind including a latch bolt for interaction with a striker formation of the door frame in use, the bolt in a latched position keeping the door fully closed, retention means cooperating with the bolt to secure it at the latched position, and release means connected with a door handle or other operating means to actuate the retention means for freeing the bolt to allow the door to open, said latches being hereinafter referred to as, "latches of the kind described".

The majority of latches of said kind in current production have a latch bolt in the form of a rotatably mounted fork or claw having a mouth in which a cylindrical portion of the striker formation is received and this type of latch is hereinafter referred to as a "rotating claw latch". While the invention is primarily described in its application to these latter latches it is to be understood that it is also applicable to other latches of the kind described e.g., having rectilinearly sliding or other forms of bolt.

According to one aspect of the invention a locking mechanism for use with a rotating claw or other latch of the kind described includes key controlled or other locking means which, when selectively put into a locked condition disables the release means to prevent actuation of the retention means by attempted operation of at least the exterior door handle or other exterior operating means; characterised in that the locking means comprises a crank element fulcrummed for angular movement about a first axis to and from an unlocked position at which the locking means is not in locked condition, a pivotal connection to a second axis on the crank element spaced from the first axis being operatively connected to a push and/or pull linkage for manual actuation of the locking mechanism by said angular movement of the crank element, e.g. linking the latter to an interior sill button in use, and deadlocking means for selectively positioning the crank element with the first and second axes substantially in line with the direction of movement of the linkage so that the latter cannot be used to effect angular movement.

Conveniently the locking mechanism further includes a rotatably driven worm shaft and a worm nut in threaded engagement therewith, longitudinal displacement of the latter carrying a locking dog into and out of drive engagement with the latch retention means, the drive dog forming part of the release means actuated by the door handle(s) or other operating means, the crank element being drivingly connected with the worm gear e.g., taking the form of a gearwheel meshed with a pinion portion of the worm gear.

The worm gear may be selectively driven by an electrical actuator motor.

The locking means may further include a solenoid operated or other retractable stop limiting movement of the crank element between the unlocked position and a locked position at which said element can still be displaced by the linkage, the stop being shifted to free the crank element for displacement to the in line condition when deadlocking is to be effected.

The invention further resides in a locking system for the driver's and passenger doors of a vehicle including a latch of the kind described respective to each said door and each provided with locking mechanism as defined by one or more of the above statement of invention paragraphs, at least each mechanism associated with a passenger door including an electrically driven actuator for selective shifting of the locking means crank elements to the locked or deadlocked positions, operation of at least the driver's door locking mechanism to deadlocked condition causing the locking mechanisms of the other doors to be automatically put into that condition also.

Figure 1B:
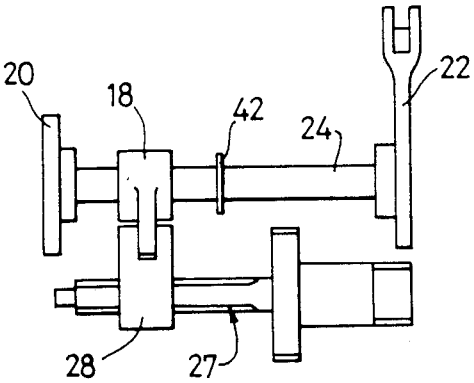
Figure 1C:
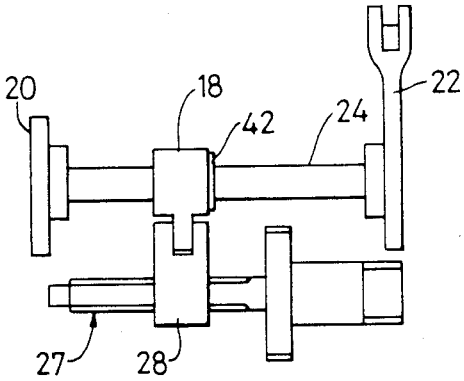
Figure 2:
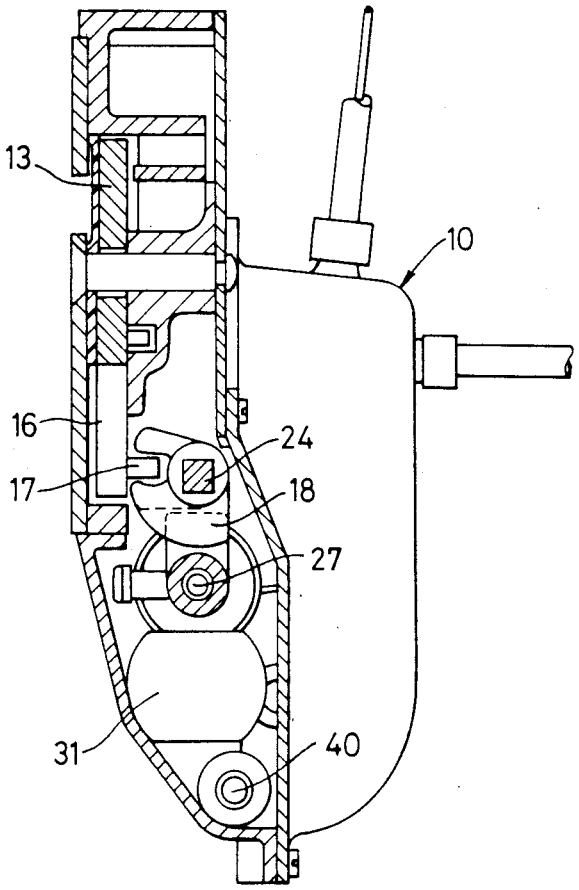
Figure 4A:
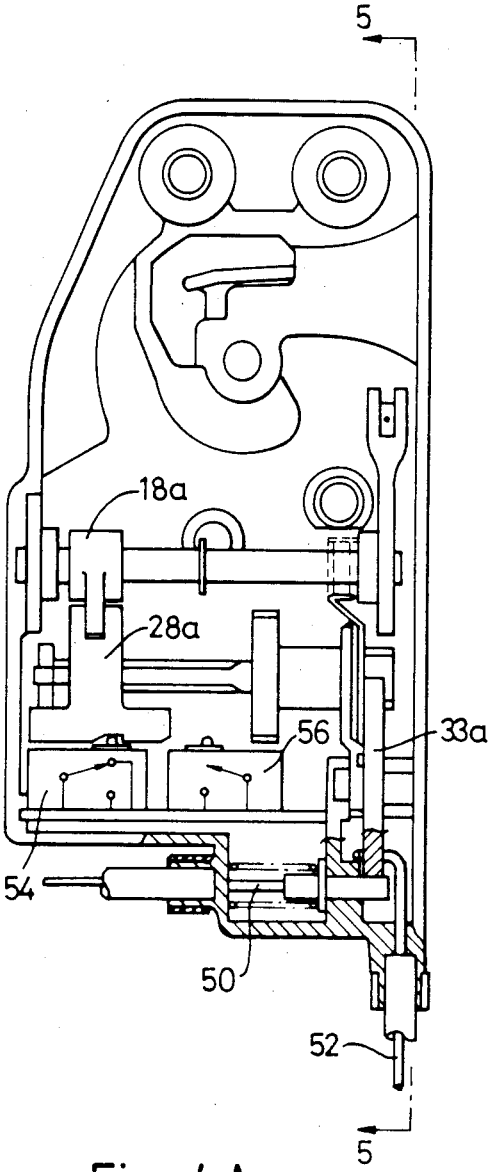
Figure 5A:
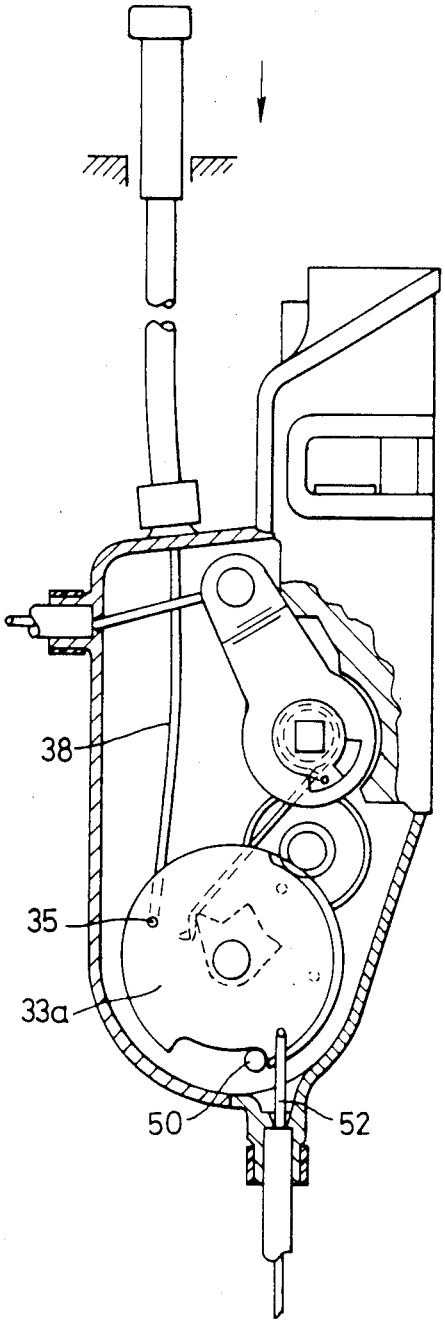
Figure 3A:
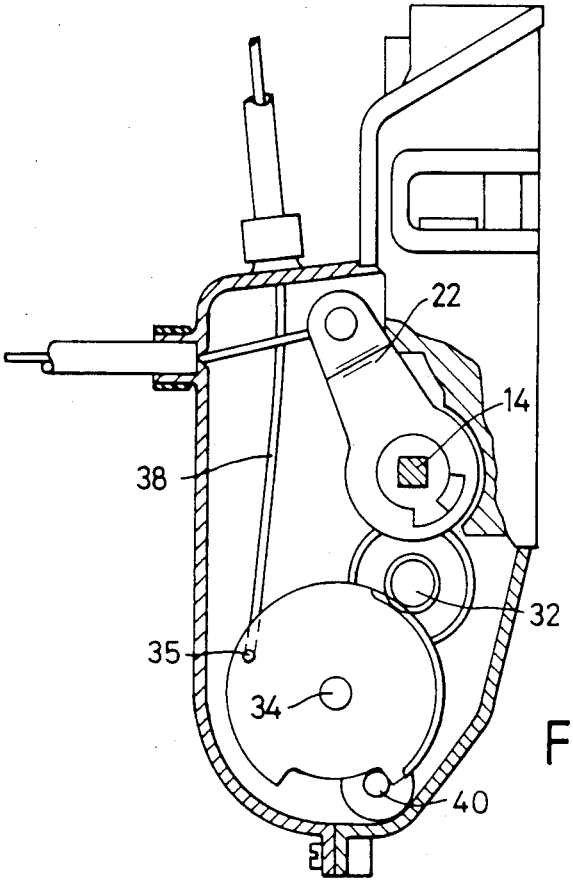
Figure 3B:
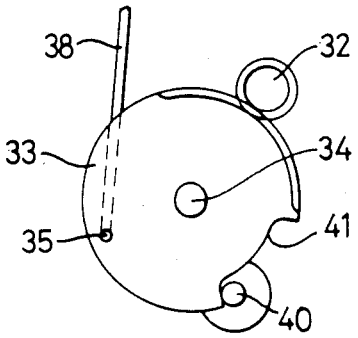
Figure 3C:
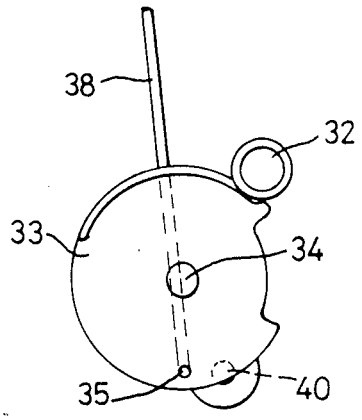
Figure 4B:
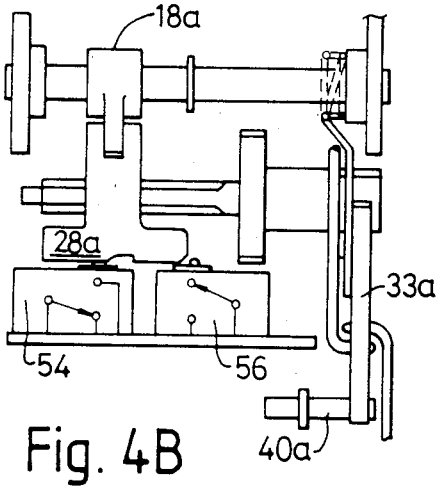
Figure 4C:
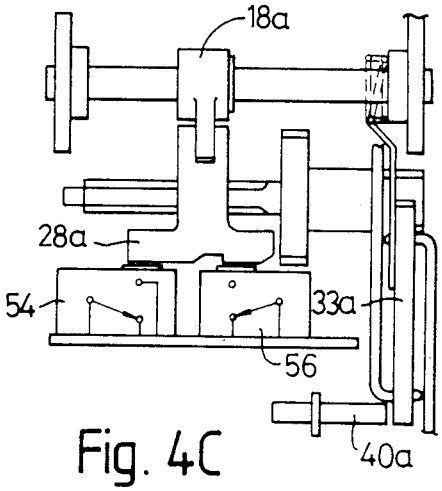
Figure 5B:
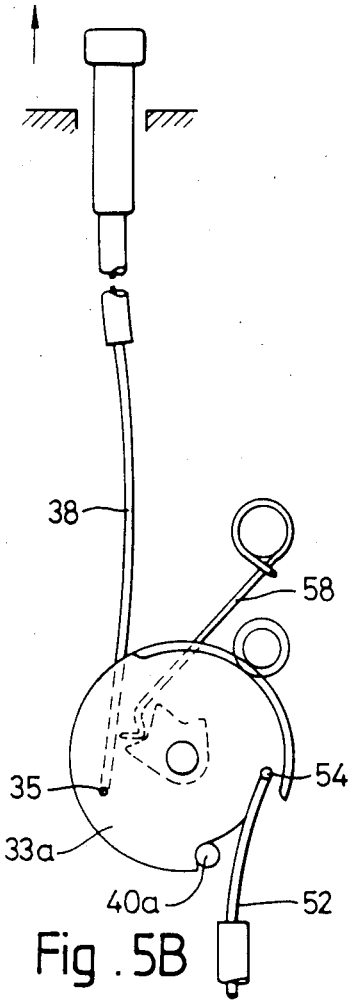
Figure 5C:
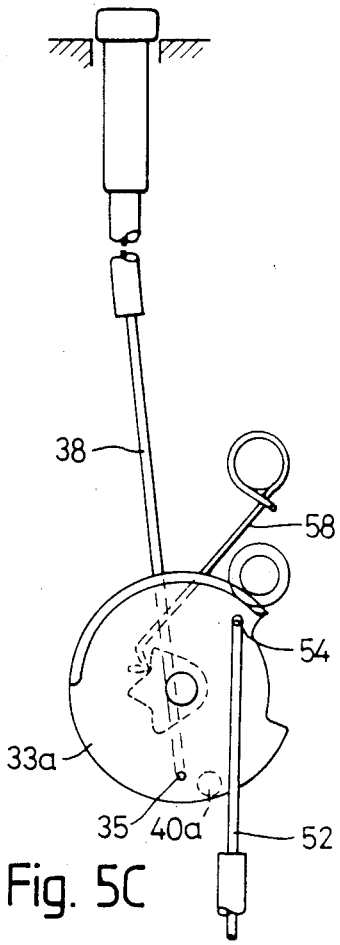
Figure 6A:
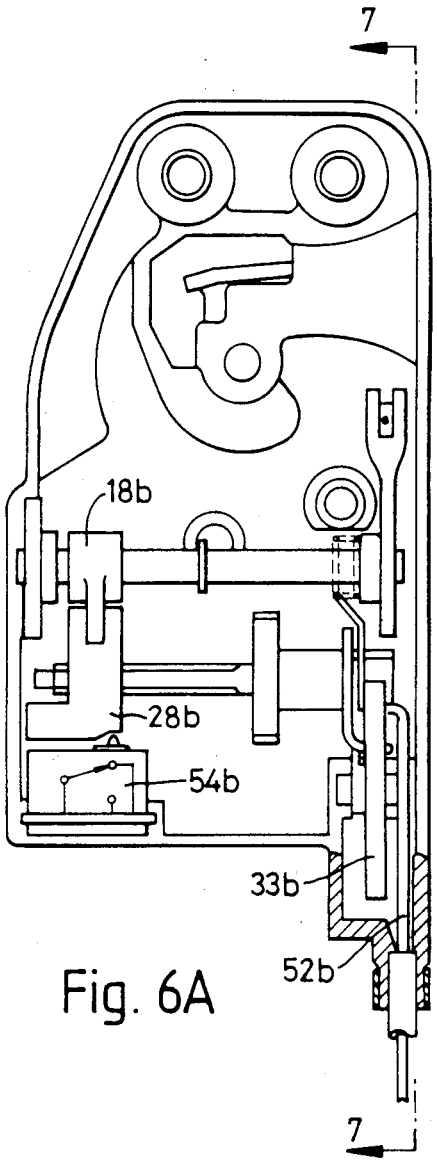
Figure 7A:
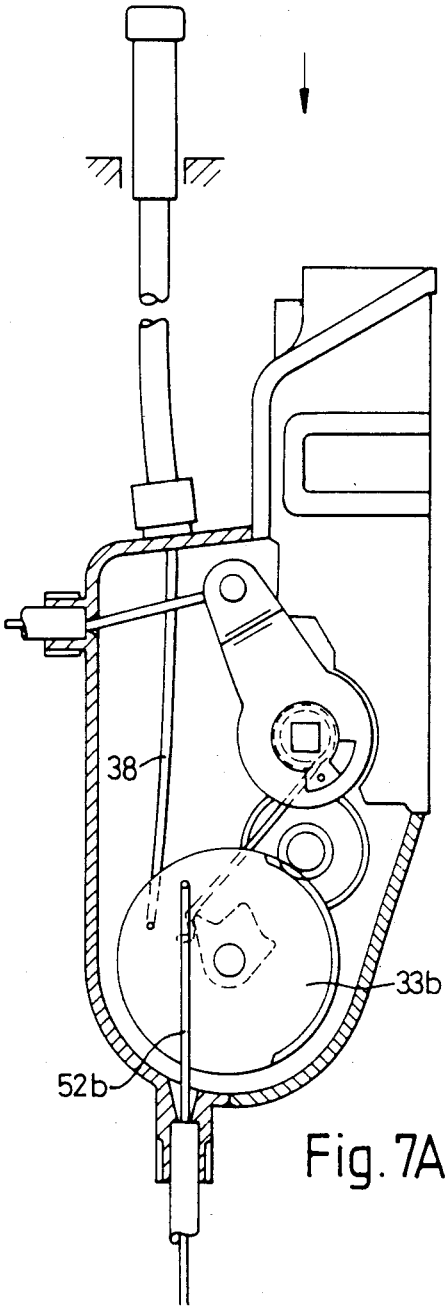
Figure 6B:
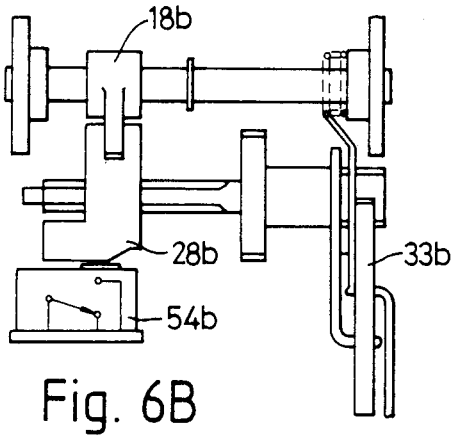
Figure 6C:
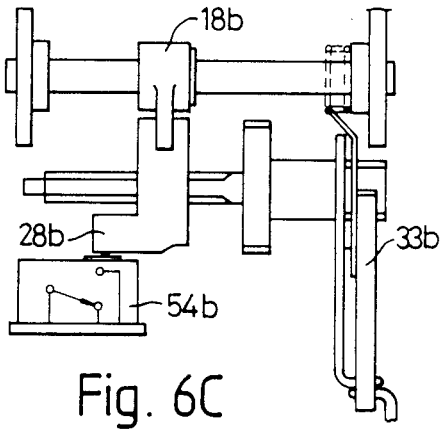
Figure 7B:
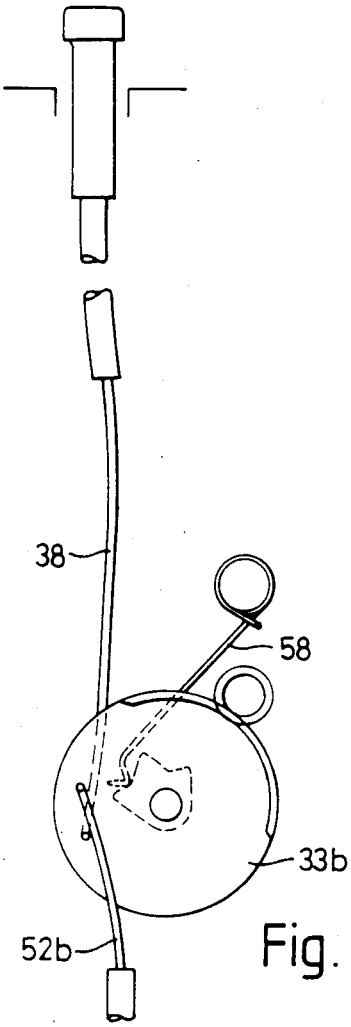
Figure 7C:
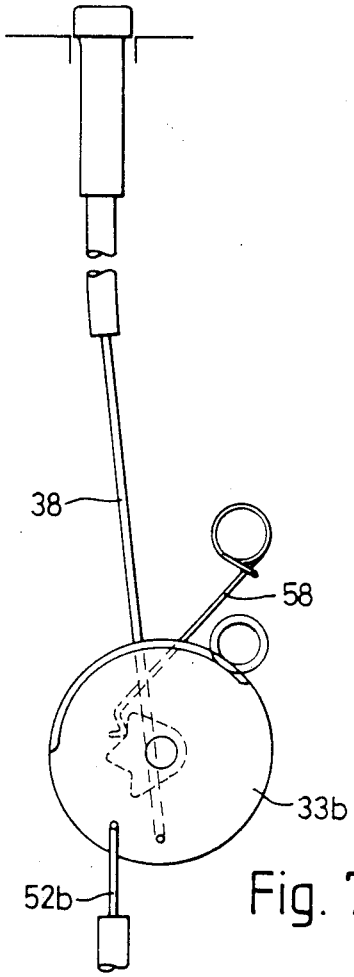
Figure 8A:
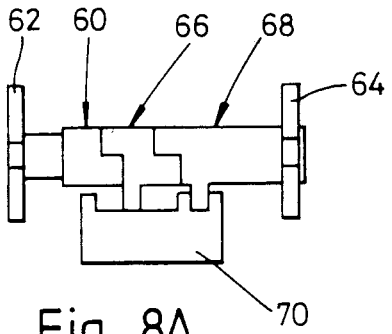
Figure 9A:
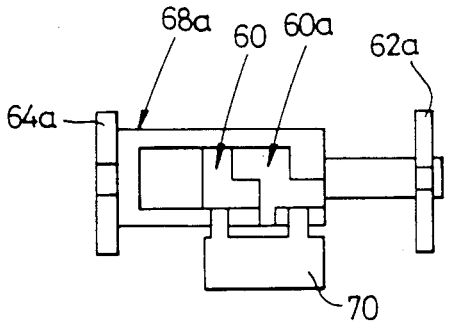
Figure 8B:
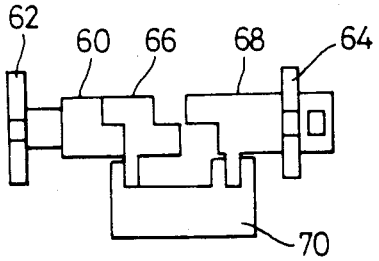
Figure 8C:
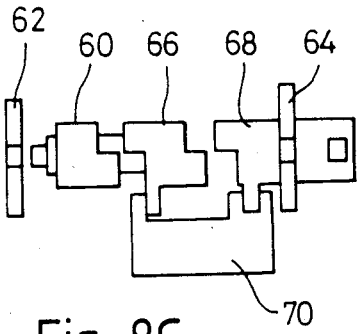

Embodiments of the invention and certain variations and modifications thereof are now more particularly described with reference to the accompanying drawings wherein:

FIG. 1A is a sectional side view of one version of a latch unit incorporating the invention, FIGS. 1B and 1C are views of components as shown in FIG. 1 but at other operating positions, FIG. 2 is a sectional view on line 2—2 of FIG. 1, FIG. 3A is a sectional view on line 3—3 of FIG. 1, FIGS. 3B and 3C are views of components as in FIG. 3A but at different operating positions, FIG. 4A is a sectional side view of a modified form of latch unit, FIGS. 4B and 4C are components as shown in FIG. 4A but at different operating positions, FIG. 5A is a sectional view on line 5—5 of FIG. 4, FIGS. 5B and 5C are views of components as shown in FIG. 5A but in different operating positions, FIG. 6A is a sectional side view of a further modified form of latch unit, FIGS. 6B and 6C show components as in FIG. 6A but at different operating positions, FIG. 7A is a part sectional view on line 7—7 of FIG. 6A, FIGS. 7B and 7C are views of components as in FIG. 7A but at different operating positions, FIGS. 8A, 8B and 8C are diagrammatic views of an alternative arrangement of handle actuated release mechanism which may optionally be incorporated in the above embodiments and, FIGS. 9A, B, and C show operating positions of another form of the latter handle operated release mechanism.

Referring firstly to FIGS. 1-3 a latch unit is shown which, in this example, includes provision for remote electrical actuation of the locking means for interconnection as part of a central locking system of a vehicle, the particular pattern of unit shown in these drawings being intended for the passenger doors of the vehicle.

The unit incorporates a rotating claw latch of generally conventional design occupying the upper part of the unit. It includes a rotary claw 13 and a pawl 16 coacting therewith in known manner. A tail portion of pawl 16 carries a peg 17.

A square section cross-shaft 24 is pivoted across a box like housing or body 10 which encloses the mechanism of the unit. A locking dog 18 in sliding but non rotational engagement on shaft 24 is provided with laterally projecting formations, e.g. a limb or limbs which coact with the peg 17 for movement of pawl 16 on rotation of cross-shaft 24 when dog 18 is positioned as shown in FIG. 1A near the lefthand end of shaft 24 as there viewed.

In this position the release means constituted in part by shaft 24 and dog 18 can operate to shift pawl 16 out of engagement with the claw 13 to permit opening of the door.

Cross-shaft 24 is rotatable by outside and inside release levers 20, 22 carried on and drivingly connected to shaft 24 through intermediate dogs in known manner and connected respectively to the interior and exterior door handles in use.

Locking means of the unit further includes a worm shaft 27 pivoted parallel to and below cross-shaft 24 having a threaded worm section 26 in screw engagement with a nut 28, a forked projection on the latter engaging each side of a downwardly extending rib on dog 18. Rotation of worm shaft 27 will shift nut 28 longitudinally so carrying dog 18 into or out of its engagement with pawl peg 17.

When it is out of said engagement the release means is disabled in that operation of the door handles will rotate cross-shaft 24 but will not displace pawl 16.

An actuator gear wheel 29 of worm shaft 27 meshes with a pinion 30 of an electric actuator motor 31 which is operatively connected into a central door locking control circuit of the vehicle, motor 31 being operated to drive nut 28 and the associated dog 18 between locked and unlocked positions.

A further pinion 32 at the righthand end of worm shaft 27 (FIG. 1A) meshes with a larger diameter deadlocking gear wheel 33 pivoted in the lower part of body 10.

This latter wheel functions as a crank element fulcrummed about a first axis 34 being its axis of rotation and carrying a second axis 35 near its periphery. In use axis 35 serves as the pivotal connection for the end of a pull-push link cable 38 which, in this example, extends upwardly and terminates at a sill button (not shown) of known kind on the interior of the door.

A retractable stop 40 cooperates with a cut-out segment 41 in the periphery of wheel 33 to limit angular movement of the latter between the position shown in FIG. 3A when the sill button is pulled fully upwards and the position shown in FIG. 3B when the button has been depressed, i.e., unlocked and locked positions, said movement of the sill button cranking wheel 33 and so causing rotation of the worm shaft 27 to shift the locking dog 18 between the acting position shown in FIGS. 1A and 2 and the disabled position shown in FIG. 1B.

A solenoid 42 is selectively operable to withdraw stop 40 so that the deadlocking gear wheel is free to rotate past the locked position shown in FIG. 3B to a deadlocked position shown in FIG. 3C at which axes 34 and 35 are substantially in line with the direction of movement of link-rod 38 thus making the latter inactive in that pulling or pushing the sill button will not causing any movement of the gearing of the locking mechanism for shifting the locking dog from its disabled condition.

To deadlock the doors in this way an electrical signal will be passed to motor 31 for driving the gear train and at the same time to actuate solenoid 42 to withdraw stop 40 so that wheel 33 is driven to the FIG. 3C position. This shifts locking dog 18 still further to the right as viewed in FIG. 1 until it abuts a limit stop 42 on cross-shaft 24 as shown in FIG. 1C. The process is reversed to remove the deadlocking and restore the mechanism to the condition in which the latch can be locked and unlocked by operation of the sill button.

The latch units for the passenger doors, or at least the rear doors, may further incorporate a child proof safety catch in known manner.

FIGS. 4 and 5 show a form of the above latch unit adapted for manual operation only but, in this example of locking system, serving as the master unit from which the passenger door units as described above can be controlled as slaves.

Parts having substantially the same form and function as those shown and described in FIGS. 1–3 are given the same reference numerals suffixed by "a" and will not be further described in detail.

In this form of latch unit there is no electric motor drive or solenoid operation of the deadlocking gear **33*a* or stop 40*a*. Instead the latter is actuated by a deadlock pull-push cable 50 which, in this example, connects to a key operated lock cylinder (not shown) on the exterior of the driver's door. This door key cylinder also operates a locking pull-push cable 52 connected to a pivot point on a third axis 54 on the deadlocking gear wheel 33*a***.

A lower portion of the nut **28*a* operated by worm shaft 27*a* is elongated and notched to coact with and operate a pair of micro switches; a locking/unlocking switch 54 on the left as viewed in FIG. 4 and a deadlocking switch 56** to the right in that Figure.

In this example a spring detent 58 coacts with a notched hub portion of the deadlocking gear wheel **33*a* for its more positive location at respective angular positions shown respectively in FIGS. 5A (unlocked condition) 5B (locked condition) and 5C (deadlocked condition) with corresponding positioning of the nut 28*a* as shown respectively in FIGS. 4A, B, C**.

Turning the key for locking from the exterior of the vehicle or pushing down the sill button for locking from the interior of the vehicle will rotate wheel **33*a* to the FIG. 5B position causing rotation of worm shaft 27*a* to shift nut 28*a* to the 4B position, disabling the connection of the locking dog 18*a* with the latch pawl. In moving to this position the lock/unlock switch 54 is actuated sending a signal to the actuator motors 31** of the passenger doors so that they are also put into the locked condition.

Deadlocking the driver's door by further operation of the key rotates wheel **33*a* to the FIG. 5C position, the stop 40*a*** being withdrawn at the same time. In this position the latch cannot be unlocked by use of the sill button, indeed it is contemplated that the button may be withdrawn so that its head is pear flush with or below the surface of the sill making any attempt to interfere with it still more difficult.

In the deadlocked condition the nut **28*a* has been shifted to its extreme righthand position (4C) where it operates the deadlocking switch 56 as well as maintaining switch 54 in its operated condition. This signals the latch units of the passenger doors for operations of their solenoids 42 to withdraw their stops 40 and at the same time drive their deadlocking wheels 33** to the deadlocked position previously described. Thus all the doors of the vehicle are deadlocked simultaneously in a particularly simple and effective way giving a high degree of security.

The operation of the system by the driver's door key is preferably arranged so that two positive movements of the key are necessary to effect deadlocking so that this cannot be done inadvertently, for example turning the key from the unlocked position through a first angle to effect locking while it is necessary both to press the key inwards and turn it through a further angle to effect deadlocking.

It is to be understood that other forms of actuation may be provided, for example electrical actuation of the driver's door latch unit by way of a central locking system could be used or made supplementary to operation as above, also it is to be understood that other doors or another door of the vehicle may be provided with a unit similar to that used for the driver's door, e.g. the front passenger door enabling key operation from either side of the vehicle. Similar or other remote actuated latch units may be interconnected to the system, e.g., for locking boot or petrol flap lids, bonnet or the like.

A further modification of the unit described with reference to FIGS. 4 and 5 is shown in FIGS. 6 and 7. Again parts having the same function are given the same reference number suffixed "b". In this arrangement there is no retractable stop acting on the deadlocking gear wheel **33*b*, instead its movement between the three positions; unlocked (FIGS. 6A and 7B), locked (FIGS. 6B and 7B), and deadlocked (FIGS. 6C and 7C) is effected solely by operation, e.g. key operation as described above, of the locking cable 52*b***, so simplifying the mechanism.

It is to be noted that in this arrangement cable **52*b* has to be pushed upwards to shift wheel 33*b*** to the unlocked condition. This is desirable from a security point of a view as any attempt to "fish" for the run of cable within the door and pull on it for attempted unlocking to gain access to the vehicle will be foiled.

This example also incorporates a single switch **54*b* only which is maintained in actuated condition at both the locked and deadlocked conditions of the nut 28*b***.

In a system using this version switch **54*b*** will actuate the slave latch units of passengers doors, e.g. to shift them fully to the deadlocked condition, whenever the driver's door is locked and/or deadlocked.

Figure 9B:
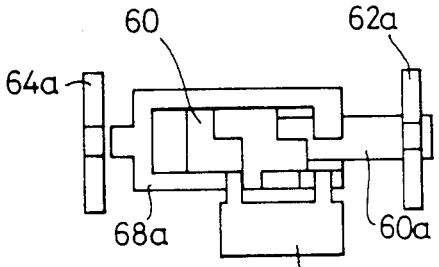
Figure 9C:
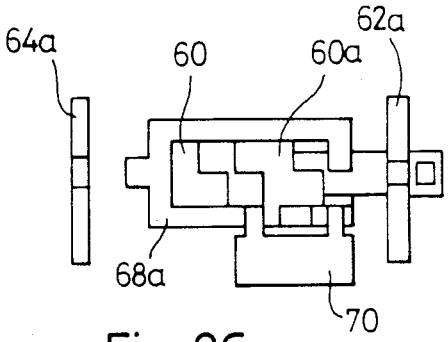

FIGS. 8 and 9 show in diagram form modified arrangements of door handle locking dogs and cross-shaft in conjunction with modified forms of worm shaft nut.

These arrangements are to provide for selective disablement of the drive connection between either or both door handles and the locking dog here numbered 60. It is to be noted that this dog is not itself shifted laterally into and out of engagement with the latch pawl, instead the drive connection thereof with the door handles is connected or disconnected.

Referring first to FIGS. 8A–C the inside door handle lever 62 is positioned to the left and the outside handle lever 64 to the right. The cross-shaft is divided into left and righthand sections 66, 68 which can be slid into and out of driving engagement with each other and/or driving engagement with the handle levers and drive dog 60. Their relative movement is effected by a specially shaped form of nut 70 which can be shifted to the left and right by the worm shaft (not shown) in the manner previously described.

In FIG. 8A sections 66 and 68 are in engagement with each other and with the dog 60 and are also clutched into driving engagement with the handle levers 62, 64. This is the fully unlocked condition in which the latch can be released by operation of either the inside or the outside handle.

In FIG. 8B section 68 has been shifted to the right, it being drive connected to nut 70 without any lost motion by a lug engaging in a forked portion of said nut. When so shifted its outer end is extended through and beyond the outside handle lever 64 so that a drive dog portion on said outer end is taken out of driving engagement with said lever. Thus the outside door handle is disabled, i.e. in locked condition leaving the inside door handle still operative. This condition may be desirable in some circumstances, e.g. where there is fear of hijacking or attack on the occupants of the vehicle and a "panic button" or other selectively operable control within the vehicle may be used to put the latch units of all the doors into this condition simultaneously.

In the third conditions shown in FIG. 8C the nut 70 has been shifted still further to the right carrying section 68 with it so that the disablement of the outside handle is maintained and at the same time lost motion connection between nut 70 and the lefthand section 66 has become effective by abutment of projecting lugs on these elements, shifting section 60 to the right by a lesser distance. This movement withdraws the lefthand end of section 66 out of drive connection with the inside handle lever 62, thus disabling both door handles.

A modified form of the above arrangement is shown in FIGS. 9A, B and C where similar mechanism is required but with the outside handle lever **64*a* to the left as viewed in the drawings and the inside handle lever 62*a* to the right. In this arrangement the cross-shaft section shifted into and out of abutment with dog 60 and acted on by the lost motion connection with nut 70 extends to the right to coact with the inside handle lever 62*a* and the section 68*a* which has positive connection with nut 70 at the righthand end is of tubular form to enclose and extend to the left beyond dog 60 so that it is shifted into and out of drive engagement with the outside handle lever 64*a*** on the left.

Other modifications and variations of the application of the invention to various known forms of latch mechanism and/or centrally operated or controlled locking systems will be apparent to those skilled in the art. For example the switches 54 and 56 may be actuated directly in response to the positioning of the key operated cylinder or the like instead of being operated by the positioning of the nut 28.

The whole of the mechanism of the locking means and latch is simple and compact and can be wholely contained and sealed within the housing 10 which can be of substantially the same shape and volume as the housings of known latch units, thus permitting upgrading of existing vehicle production without need to modify the door pressings and components. The use of the invention will add substantially to vehicle security in an economical and particularly effective manner.

I claim:

1. A vehicle door latch assembly, comprising:

(a) a latch bolt for interaction with a striker formation of an associated door frame in use, the bolt in a latched position keeping the door fully closed;

(b) retention means cooperating with the bolt to secure it at the latched position;

(c) release means connected to interior and exterior door handles or other operating means in use to actuate the retention means for freeing the bolt to allow the door to open, said release means including a locking dog displaceable between an active position at which it drivingly connects said operating means for movement of the retention means and an inactive position at which the operating means is disconnected from the retention means;

(d) locking mechanism comprising locking means which when in a locked condition disables the release means to prevent actuation of the retention means by attempted operation of at least the exterior door handle or other exterior operating means in use, said locking means including:

(i) a rotatably driven worm shaft and a worm nut in threaded engagement therewith, displacement of the nut along the shaft carrying said dog between the active and inactive positions;

(ii) a crank element fulcrummed for selective angular movement about a first axis to a first angular position at which the locking means is not in the locked condition and to second and third angular positions at both of which the locking means is in the locked condition, and (iii) a linkage having pivotal connection to the crank element on a second axis spaced from the first axis for effecting said angular movement of the crank element manually; and (e) deadlocking means selectively operable to cause the crank element to take up the third angular position, the first and second axes being substantially in line with the direction of operative movement of the linkage at the latter position whereby the linkage cannot be used to effect angular movement of the crank element from that position to return the locking means to unlocked condition.

2. An assembly as in claim 1, wherein the linkage operatively connects the crank element to an interior sill button of the door.

3. An assembly as in claim 1, wherein the release means includes first and second handle levers for operative connection to interior and exterior door handles, and clutch means selectively operable for drive connection and disconnection of one or both said levers with the retention means.

4. An assembly as in claim 3 wherein the release means further includes a locking dog in driving connection with the retention means, said locking dog and both said levers being disposed coaxially and guided for axial displacement relative to each other to effect said selective drive connection and disconnection of the clutch means.

5. An assembly as in claim 1 wherein the crank element is drivingly connected with the worm shaft.

6. An assembly as in claim 5 wherein the crank element is a gearwheel meshed with a pinion portion of the worm shaft.

7. An assembly as in claim 1, wherein said worm shaft is selectively driven by an electrical actuator motor of the latch assembly.

8. An assembly as in claim 1, wherein the assembly includes selectively operable stop means limiting movement of the crank element from the unlocked position to a locked position at which locked position the crank element can still be displaced by operation of the linkage, the stop being shifted to permit the crank element to move beyond the locked position to said in line condition when deadlocking is to be effected.

9. An assembly as in claim 8, wherein said stop means is remotely actuated electrically.

10. An assembly as in claim 8, wherein said stop means is remotely actuated by a deadlock pull-push element.

11. An assembly as in claim 1, comprising switch means actuated in response to movement of the crank element to a locked and/or a deadlocked condition to provide a signal or respective signals for automatic operation of one or more slave latch assemblies of another door or doors of the vehicle to corresponding condition in use.

12. A locking system for the driver's and passenger doors of a vehicle comprising a latch assembly as defined in claim 1 respective to each said door interconnected so that operation of at least the latch assembly of the driver's door to deadlocked condition causes the latch assemblies of the other doors to be automatically put into that condition.

* * * * *